US007615096B1

(12) United States Patent
Tai et al.

(10) Patent No.: US 7,615,096 B1
(45) Date of Patent: Nov. 10, 2009

(54) METHOD FOR MANUFACTURING METAL NANOPARTICLE

(75) Inventors: Yi-Der Tai, Taipei (TW); Yao-Hsuan Wang, Taipei (TW); Ming-Hui Chang, Taipei (TW)

(73) Assignee: National Taiwan University, Taipei (TW)

( * ) Notice: Subject to any disclaimer, the term of this patent is extended or adjusted under 35 U.S.C. 154(b) by 199 days.

(21) Appl. No.: 11/622,332

(22) Filed: Jan. 11, 2007

(30) Foreign Application Priority Data

Jul. 28, 2006 (TW) ..... 95127905 A

(51) Int. Cl.
*B22F 9/24* (2006.01)

(52) U.S. Cl. ..... 75/333; 75/351; 75/370; 977/896

(58) Field of Classification Search ..... 75/371
See application file for complete search history.

(56) References Cited

U.S. PATENT DOCUMENTS 6,929,675 B1 8/2005 Bunge et al.
2005/0056118 A1* 3/2005 Xia et al. ..... 75/330
2005/0183543 A1* 8/2005 Sasaki et al. ..... 75/371
2006/0159603 A1* 7/2006 Vanheusden et al. ..... 423/1
2007/0056402 A1* 3/2007 Cho et al. ..... 75/362
2007/0234851 A1* 10/2007 Goia et al. ..... 75/371
2008/0064767 A1* 3/2008 Chou et al. ..... 516/97

FOREIGN PATENT DOCUMENTS

TW 200426114 11/2004

OTHER PUBLICATIONS

Chou et al., Synthesis of nanosized silver particles by chemical reduction method, Materials Chemistry and Physics 64, 2000, pp. 241-246, Oct. 22, 2003.
Raveendran et al., Completely "Green" Synthesis and Stabilization of Metal Nanoparticles, Journal of American Chemistry Society, 2003, vol. 125, pp. 13940-13941.

* cited by examiner

*Primary Examiner*—George Wyszomierski
(74) *Attorney, Agent, or Firm*—Volpe and Koenig, PC

(57) ABSTRACT

A method for manufacturing a metal nanoparticle is provided. The method includes steps of: a) providing a metal salt solution, b) providing a reducing agent, c) providing a protecting agent, d) providing an alkaline solution, e) mixing the salt solution, the reducing agent, the protecting agent and the alkaline solution to form a slurry within a high-gravity field, and f) separating the metal nanoparticle from the slurry.

6 Claims, 6 Drawing Sheets

METHOD FOR MANUFACTURING METAL NANOPARTICLE

FIELD OF THE INVENTION

The present application relates to a method for manufacturing metal nanoparticles. In more detail, the present application relates to a method that employs a spinning disk reactor (SDR), which is one type of high-gravity device, to synthesize metal nanoparticles.

BACKGROUND OF THE INVENTION

Since metal nanoparticles possess huge surface areas and very high chemical activities, they have now become a popular topic of investigation in various fields. For example, silver nanoparticles have shown outstanding performance in aspects such as conductivity, optical and thermal properties, and catalyzing reaction. Research has also demonstrated that silver nanoparticles are capable of sterilizing bacteria and viruses without harming the body and the environment. Thus, they are regarded as sterilizing materials, which offer superior safety. In light of these desirable features, the method for preparing and manufacturing silver nanoparticles has attracted much attention from various industries.

There are several conventional methods for manufacturing metal nanoparticles, including chemical reduction, microemulsion, photovoltaic method, pyrolysis, mechanical grinding, and physical vapour deposition. In which, the most common one is the chemical reduction method. The advantages of using the chemical reduction method include its low capital cost and its simple operation. It is also applicable to non-metal materials and metal alloy materials. The industrial chemical reduction method is often performed in a batch reactor. Even though the procedure is simple, the size of the end product is often too large and widely distributed. Furthermore, the production rate using this method is also low.

The published methods for manufacturing metal nanoparticles to date are numerous. For example, Wallen et al. has published an article entitled 'Completely "Green" Synthesis and Stabilization of Metal Nanoparticles' (Journal of American Chemistry Society, 2003, 125: 13940-13941), which described a method of manufacturing silver nanoparticles using glucose and silver nitrate as reactants and starch as protecting agent. The process requires the temperature to be set at 40° C. and a reaction time of 20 hours. Ren et al. published an article entitled 'Synthesis of nanosized silver particles by chemical reduction method' (Materials Chemistry and Physics, 2000, 64: 241-246), which described a method of manufacturing silver nanoparticles using silver nitrate, formaldehyde and polyvinylpyrrolidone (PVP) with a reaction time of 60 minutes. On the other hand, the method disclosed in the U.S. Pat. No. 6,929,675 reacts ($Cu(C_6H_2(CH_3)_3)_5$, $(Ag(C_6H_2(CH_3)_3)_4$ or $(Au(C_6H_2(CH_3)_3)_5$ with amine at a temperature slightly over 100° C. for at least 1 minute to manufacture nanoparticles of copper, silver or gold. A method disclosed in the Taiwan Patent Open No. 200426114 (whose application number is 92113427) manufactures silver nanoparticles by reacting silver nitrate solution and trisodium citrate solution at 65-150° C. for 0.5-60 minutes.

The conventional methods for manufacturing metal nanoparticles are generally time-consuming (the reaction time is at least 1 minute and often in the hours). The conventional methods also require the use of a huge quantity of chemicals such as formaldehyde that is detrimental to the environment. Therefore, in order to protect the environment, industry has focused on developing a method for manufacturing metal nanoparticles that incorporates both features of fast reaction and minimal impact on the environment.

In order to overcome the drawbacks of the inability of conventional method to achieve fast reaction and minimal environment impact simultaneously, a new method for manufacturing metal nanoparticles is desired.

SUMMARY OF THE INVENTION

In accordance with an aspect of the present application, a method for manufacturing a metal nanoparticle is provided. The method includes steps of: a) providing a metal salt solution, b) providing a reducing agent, c) providing a protecting agent, d) providing an alkaline solution, e) mixing the salt solution, the reducing agent, the protecting agent and the alkaline solution to form a slurry within a high-gravity field, and f) separating the metal nanoparticle from the slurry.

Preferably, the metal nanoparticle is a silver nanoparticle.

Preferably, the protecting agent is one of a starch and a polyvinylpyrrolidone (PVP).

Preferably, the alkaline solution has a pH ranged from 11.5 to 14.

Preferably, the pH is preferably ranged from 12.3 to 13.8. Preferably, the reducing agent is a glucose.

Preferably, the high-gravity field is ranged from 1 g to 1000 g and is provided by centrifugation.

Preferably, the high-gravity field is preferably ranged from 700 g to 1000 g.

Preferably, the metal salt solution is a silver nitrate solution. Preferably, the method is performed at a temperature ranged from 10° C. to 99° C. under 1 atm.

Preferably, the temperature is preferably 25° C.

Preferably, the metal nanoparticle is a palladium nanoparticle.

Preferably, the protecting agent is polyvinylpyrrolidone (PVP).

Preferably, the alkaline solution has a pH ranged from 12.5 to 14.

Preferably, the pH is preferably ranged from 13 to 13.8.

Preferably, the reducing agent is glucose.

Preferably, the high-gravity field is ranged from 1 g to 1000 g and is provided by centrifugation.

Preferably, the high-gravity field is preferably ranged from 700 g to 100 g.

Preferably, the metal salt solution is a palladium(II) nitrate solution.

Preferably, the method is performed at a temperature ranged from 35° C. to 99.9° C. under 1 atm.

Preferably, the temperature is preferably ranged from 50° C. to 99.9° C.

Preferably, the method further includes steps of washing and drying the metal nanoparticle.

In accordance with another respect of the present application, a method for forming a metal nanoparticle is provided. The method includes steps of: a) mixing a metal salt solution, an additive and an alkaline solution having a pH greater than 11.5 within a gravity field to form a slurry and b) separating the metal nanoparticle from the slurry.

Preferably, the high-gravity field is ranged from 1 g to 1000 g and is provided by a centrifugation to mix the metal salt solution, the additive and the alkaline solution.

Preferably, the high-gravity field is preferably ranged from 700 g to 100 g.

Preferably, the additive includes a reducing agent and a protecting agent.

Preferably, the method further includes steps of washing and drying the metal nanoparticle.

In accordance with a further respect of the present application, a method for generating a metal nanoparticle is provided. The method includes steps of: a) mixing a metal salt solution, an additive and a first alkaline solution having a pH greater than 11.5 within a first high-gravity field to form a first dispersed slurry, b) mixing the first dispersed slurry with a second alkaline solution with a pH greater than 11.5 with a second high-gravity field to form a second dispersed slurry, and c) separating the metal nanoparticle from the slurry.

Preferably, each of the first and second high-gravity fields is ranged from 1 g to 1000 g and provided by centrifugation.

Preferably, each of the first and second high-gravity fields is preferably ranged from 700 g to 1000 g.

Preferably, the additive includes a reducing agent and a protecting agent.

The above contents and advantages of the present application will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Recent developments in the technology have seen a new method called 'high-gravity reactive precipitation' technology, which has greater yield from a smaller reactor, giving greater efficiencies. This method utilizes a high centrifugal force to form an extremely thin liquid film on the spinning disk, shortening the time required for mixing at micro scale and strengthens the rate of mass transfer.

Figure 1:
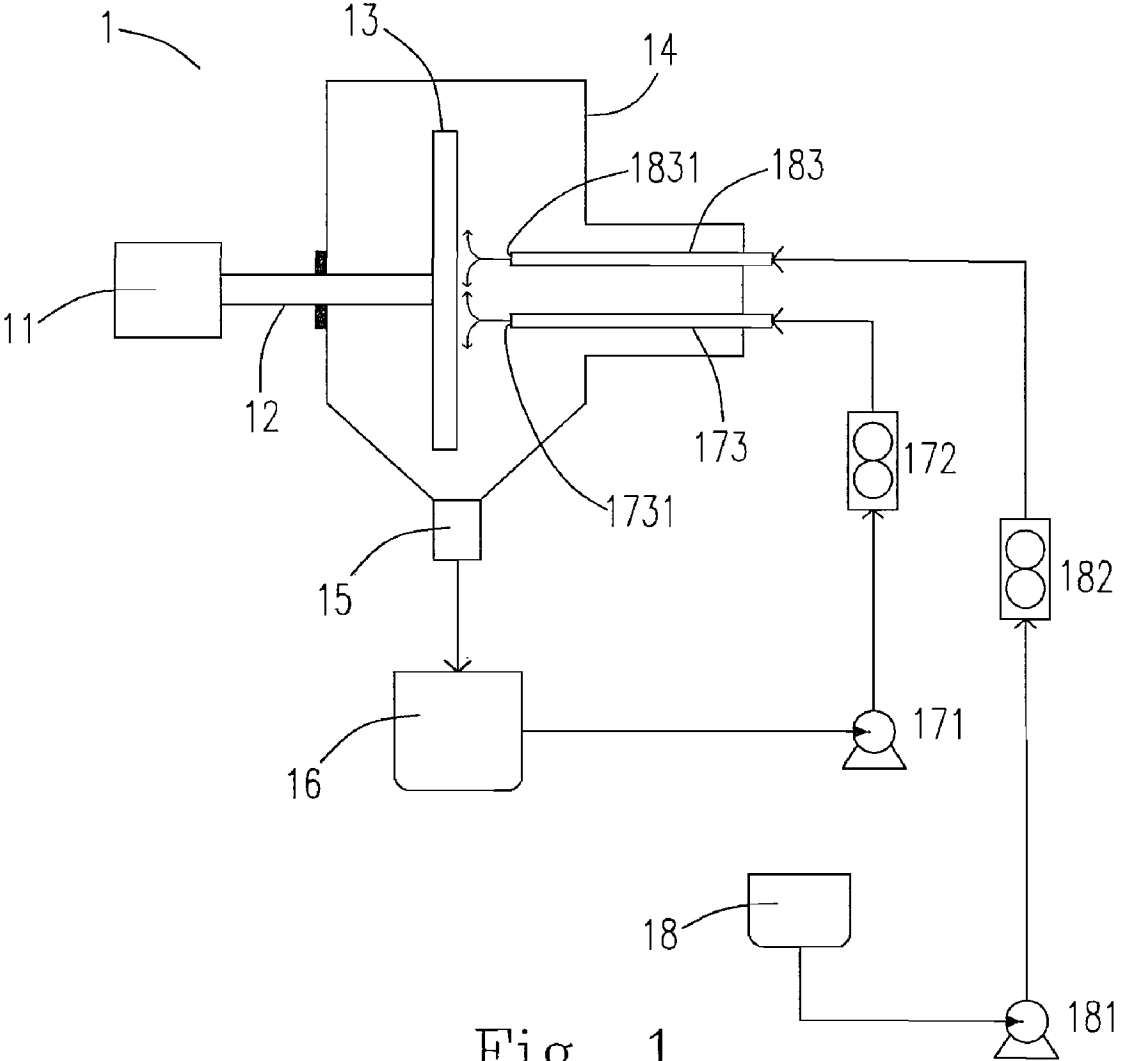
FIG. 1 is a preferred embodiment of the spinning disk reactor according to the present application.
Figure 2:
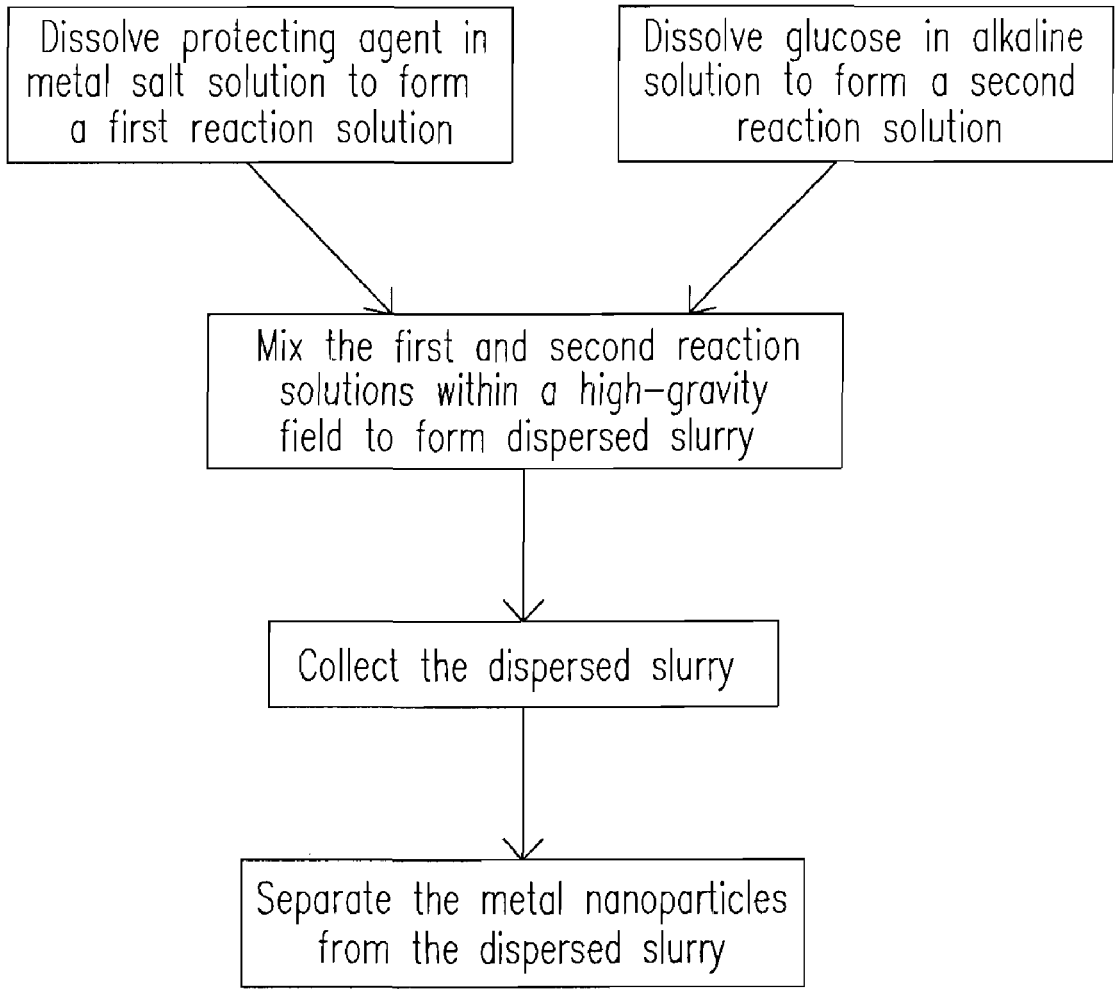
FIG. 2 is a flow chart showing a method for manufacturing metal nanoparticles according to a preferred embodiment of the present application.

Please refer to FIG. 1 and FIG. 2. FIG. 1 is a diagram showing the spinning disk reactor according to a preferred embodiment of the present application, and FIG. 2 is a flow diagram illustrating a method for manufacturing metal nanoparticles according to a preferred embodiment of present application. As shown in FIG. 1, the spinning disk reactor 1 includes variable speed motor 11, connecting rod 12, spinning disk 13, reactor 14, slurry outlet 15, slurry collection tank 16, storage tank 18, first pump 171, second pump 181, first flow meter 172, second flow meter 182, first ejecting tube 173 and second ejecting tube 183. In which, first ejecting tube 173 has a first ejecting opening 1731, and second ejecting tube 183 has a second ejecting opening 1831.

Spinning disk 13 is a stainless steel plate with a diameter of 19.5 cm. Variable speed motor 11 can be adjusted between 100-5000 rpm, preferably with 1000-4000 rpm. First ejecting tube 173 and second ejecting tube 183 are installed in perpendicular to the spinning disk 13 and located symmetrically to the center of the spinning disk 13. The distance between ejecting opening, 1731 or 1831 and the spinning disk 13 is 5 mm. In addition, after testing, it was found that the spinning disk reactor 1 is capable of providing a high-gravitational field of up to 913 g.

The following is a description of a preferred embodiment of the procedure for manufacturing silver nanoparticles proposed in the present invention.

Please refer to the cyclic operation shown in FIG. 1 and FIG. 2. During an operation, silver nitrate solution and protecting agent (such as starch or PVP) are initially placed in tank 16. Alkaline (such as sodium hydroxide) and glucose solution (used as reducing agent) are placed in storage tank 18. By setting the flow rates of first pump 171, and second pump 181, the solutions in both tank 16 and tank 18 are pumped through first ejecting tube 173 and second ejecting tube 183 onto the surface of spinning disk 13 where these solutions are mixed to form slurry. The solution flow rates are measured by first flow meter 172 and second flow meter 182 respectively. This procedure is carried out at room temperature. The slurry formed is collected in collection tank 16 to mix with the unreacted solution, and the mixture is pumped cyclically. After solution in storage tank 18 is completely ejected, the slurry in collection tank 16 continues to recycle for 5 minutes. The flow rate of collection tank 16 is set at 0.8 L/min whilst that of storage tank 18 is at 0.2 L/min. The operation time in total is 10 minutes.

At the end, the particles are separated from the slurry, the separated particles are washed with a mixture of water and acetone at the volume ratio of 1:3. The washed product was then dried in a 60° C. environment for 24 hours. After drying is completed, the yield is calculated by dividing the actual mass gained by the theoretical silver mass of complete reaction. Zeta-sizer is used to analyze the distribution of particle size, whilst the morphology of particles (results not shown) is observed by using Transmission Electron Microscope (TEM) and Scanning Electron Microscope (SEM).

During operation, the adjusted variables include: the concentration, flow rate and pH of reactants, and type of protecting agent (starch or PVP). The effects of operating variables on the yield and particle size of silver nanoparticles are illustrated in Table 1 below.

TABLE 1

The effects of operating variables on the yield and particle size of silver nanoparticles.

| | Run number | | | | | | | | |
|---|---|---|---|---|---|---|---|---|---|
| | 1 | 2 | 3 | 4 | 5 | 6 | 7 | 8 | 9 |
| pH | 13.1 | 12.9 | 12.8 | 12.3 | 12.9 | 12.9 | 12.9 | 12.9 | 12.9 |
| Glucose concentration (M) | 0.01 | 0.01 | 0.01 | 0.01 | 0.05 | 0.01 | 0.05 | 0.01 | 0.01 |
| Protecting agent | PVP | PVP | PVP | PVP | PVP | starch | starch | PVP | PVP |
| Protecting agent/ Silver nitrate(g/g) | 1 | 1 | 1 | 1 | 1 | 1 | 1 | 5 | 0.5 |
| Yield (%) | 86.6 | 70.9 | 65.6 | 50.0 | 88.1 | 60.0 | 70.9 | 49.6 | 92.0 |
| Number average particle diameter (nm) | 32.9 | 5.2 | 4.2 | 8.7 | 10.4 | 16.0 | 21.8 | 2.3 | 9.1 |
| Volume average particle diameter (nm) | 102.4 | 6.9 | 5.4 | 9.9 | 12.7 | 16.4 | 22.4 | 3.1 | 13.0 |

Other operating conditions: the flow rate for silver nitrate and protecting agent in collection tank 16 (such as starch or PVP) is 0.8 L per minute, and the flow rate of alkaline (such as sodium hydroxide) and glucose solution in storage tank 18 is 0.2 L per minute. The concentration of silver nitrate is 0.01 M. The disk rotating speed is 4000 rpm and the total reaction time is 10 minutes.

Table 1 demonstrates that different operating variables have different effects on the production of silver nanoparticles.

A. From the embodiments (run 1 to run 4) in Table 1, increasing pH values enhances the yield up to 86.6%.

B. From the embodiments (run 2 and run 5; run 6 and run 7) in Table 1, the average size by number of silver nanoparticles increases with increased concentration of glucose. Furthermore, the yield of silver nanoparticles is also elevated when the glucose concentration increases.

C. From the embodiments (runs 2, 3, 5, 6, 7) in Table 1, the obtained particle size by using starch as protecting agent (run 6 and run 7) is greater than that using PVP as protecting agent (runs 2, 3, 5) when the pH is at 12.8~12.9.

D. From the embodiments (runs 2, 8, 9) in Table 1, when the amount of PVP increases, the average particle size becomes smaller. However, the yield consequently decreases.

Figure 3:
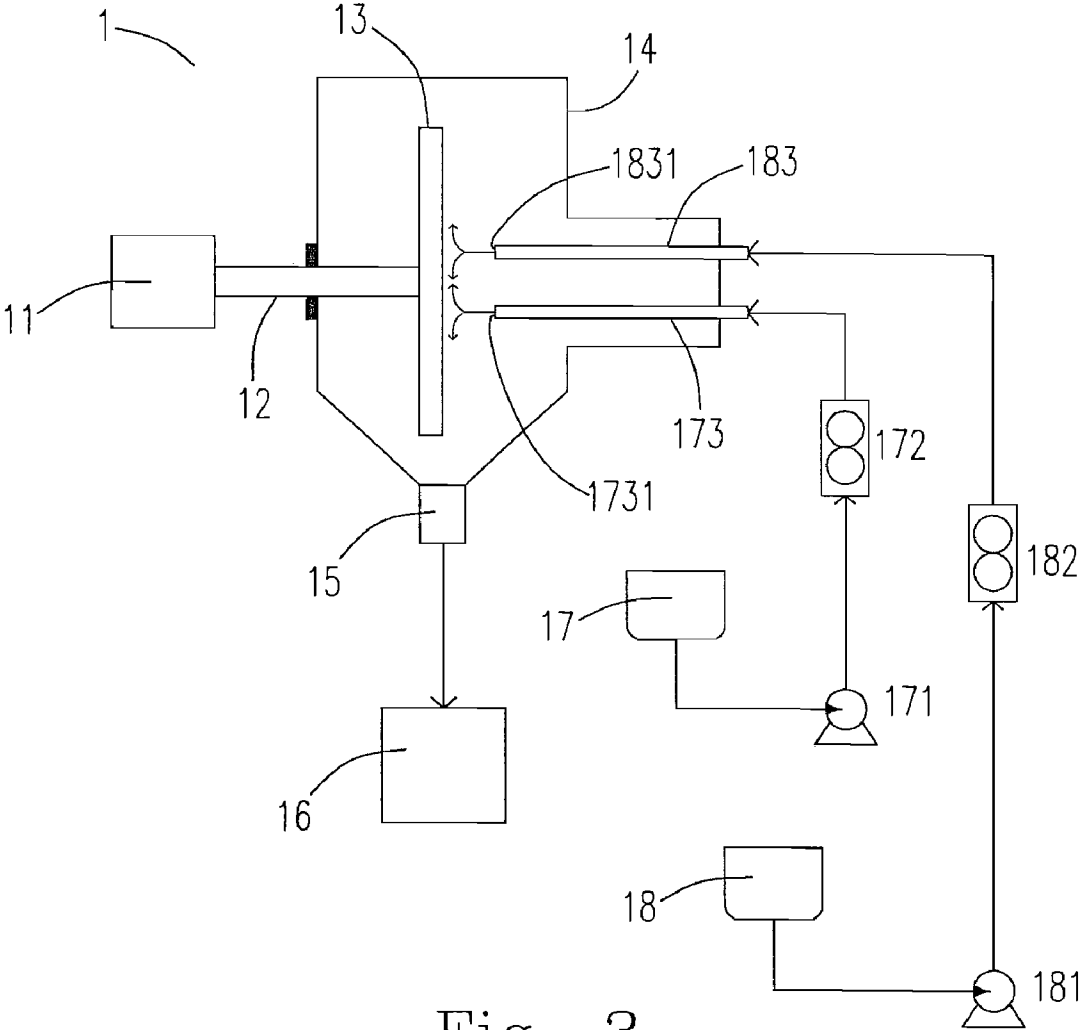
FIG. 3 is another preferred embodiment of the spinning disk reactor according to the present application.

The synthesis of metal nanoparticles could also be performed by using a continuous mode. Please refer to FIG. 3, which is a spinning disk reactor according to another preferred embodiment of the present application. As shown in FIG. 3, the spinning disk reactor 1 includes variable speed motor 11, connecting rod 12, spinning disk 13, reactor 14, slurry outlet 15, collection tank 16, first storage tank 17, second storage tank 18, first pump 171, second pump 181, first flow meter 172, second flow meter 182, first ejecting tube 173 and second ejecting tube 183. In which, spinning disk 13 is a stainless steel turntable with a diameter of 19.5 cm. Variable speed motor 11 has rotating speed between 100-5000 rpm, and preferably with 1000-4000 rpm. First ejecting tube 173 and second ejecting tube 183 are installed in perpendicular to the spinning disk 13 and located symmetrically to the center of the spinning disk 13. The distance between ejecting opening, 1731 or 1831 and the spinning disk 13 is 5 mm. In addition, after testing, it was found that the spinning disk reactor 1 is capable of providing a high gravitational field of up to 913 g.

Please refer to FIG. 3, which is a preferred embodiment of a continuous method for manufacturing silver nanoparticles. The solution in first storage tank 17 is silver nitrate solution (concentration of 0.01M) and PVP (the same amount of silver nitrate). The solution in second storage tank 18 is glucose solution (concentration of 0.01M) and sodium hydroxide with a pH of 12.9. The rotating speed of spinning disk 13 is 4000 rpm. The flow rate from first storage tank 17 and second storage tank 18 is adjusted to the range between 0.3 L/min and 1.5 L/min by controlling first pump 171 and second pump 181, respectively. Continuous operation within this flow rate range allows examination of the effect of flow rate on silver nanoparticles. The effects of flow rate on the yield and particle size are illustrated in Table 2.

TABLE 2

The effect of flow rate on the yield and size of silver nanoparticles.

| Run number | 10 | 11 | 12 | 13 | 14 |
|---|---|---|---|---|---|
| Flow rate (L/min) | 0.3 | 0.5 | 0.8 | 1.0 | 1.5 |
| Yield (%) | 59.1 | 61.1 | 62.4 | 69.4 | 67.6 |
| Number average particle diameter (nm) | 2.1 | 3.9 | 3.8 | 3.4 | 2.7 |

Figure 4A:
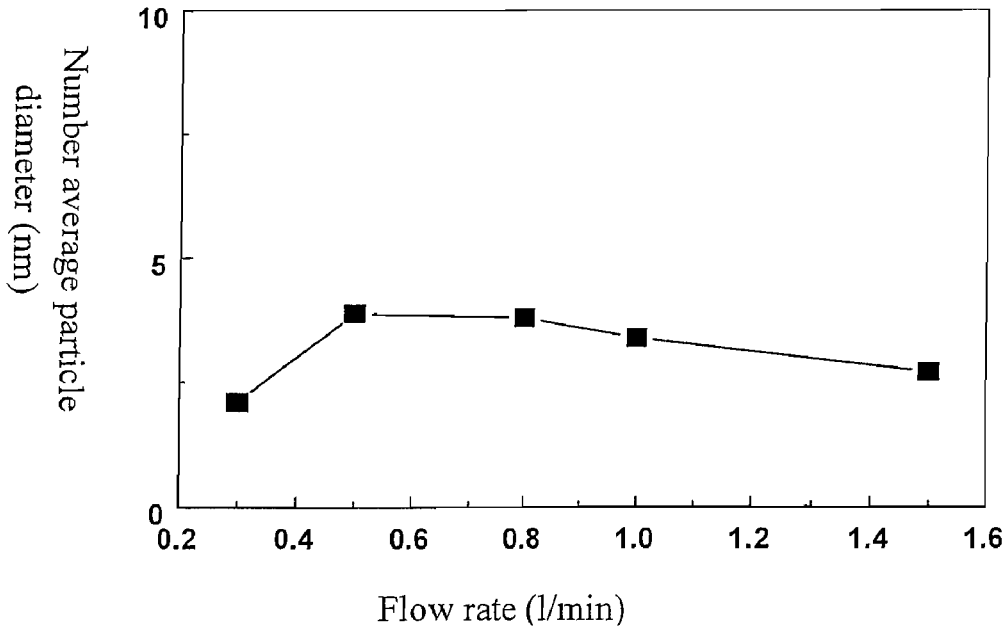
FIG. 4A and FIG. 4B illustrate the effect of different flow rates on the average particle diameter and yield of silver nanoparticles according to a preferred embodiment of the present application.
Figure 4B:
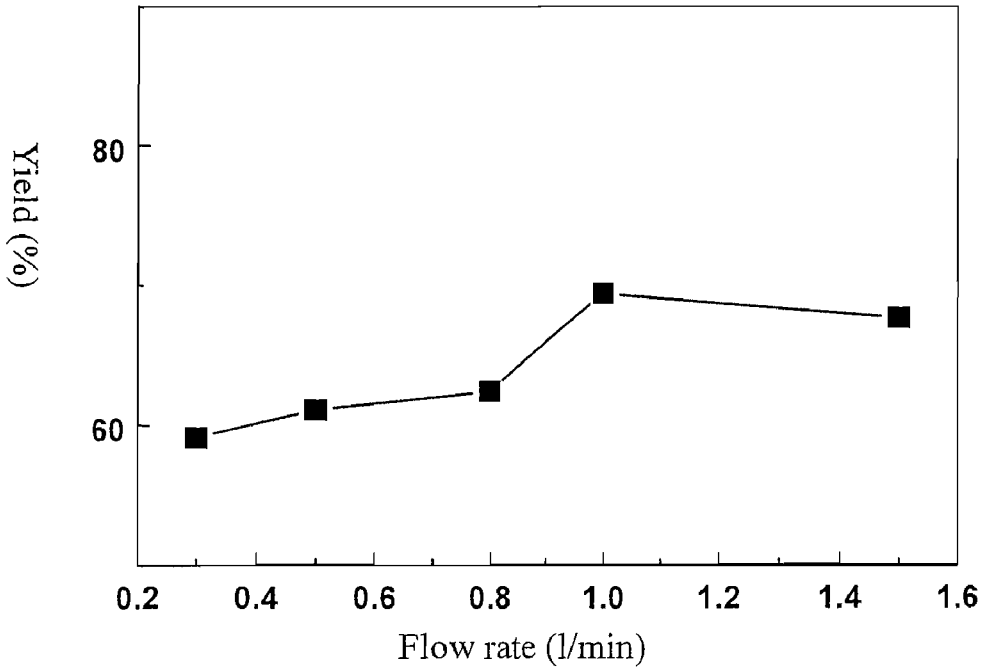

The results show that the flow rate has different effect on number average particle diameter and yield (please refer to FIG. 4A and FIG. 4B). As shown in FIG. 4A and Table 2, the particle diameter is between 2-4 mm with slight variation. Therefore, when the flow rate is set between 0.3 L/min and 1.5 L/min, the micromixing state keeps the same, and the concentration of reactants on spinning disk 13 is quite uniform. When examining the yield (FIG. 4B and Table 2), although the total yield is around 60%, the yield per unit time increases with the increase of flow rate. It is shown in Table 2 that the yield and particle size obtained by continuous mode are smaller than that by cyclic mode. It is to be noted that the salt used is not limited to silver nitrate and could be of other silver containing salts, such as silver chloride, silver sulfide, silver bromide, silver sulfate or silver chlorate. Since the main purpose of using alkaline solution is to maintain the relevant reaction under a highly alkaline situation, the actual alkaline solution used is not restricted to sodium hydroxide. Therefore, it is not a necessity to use sodium hydroxide only.

Figure 5:
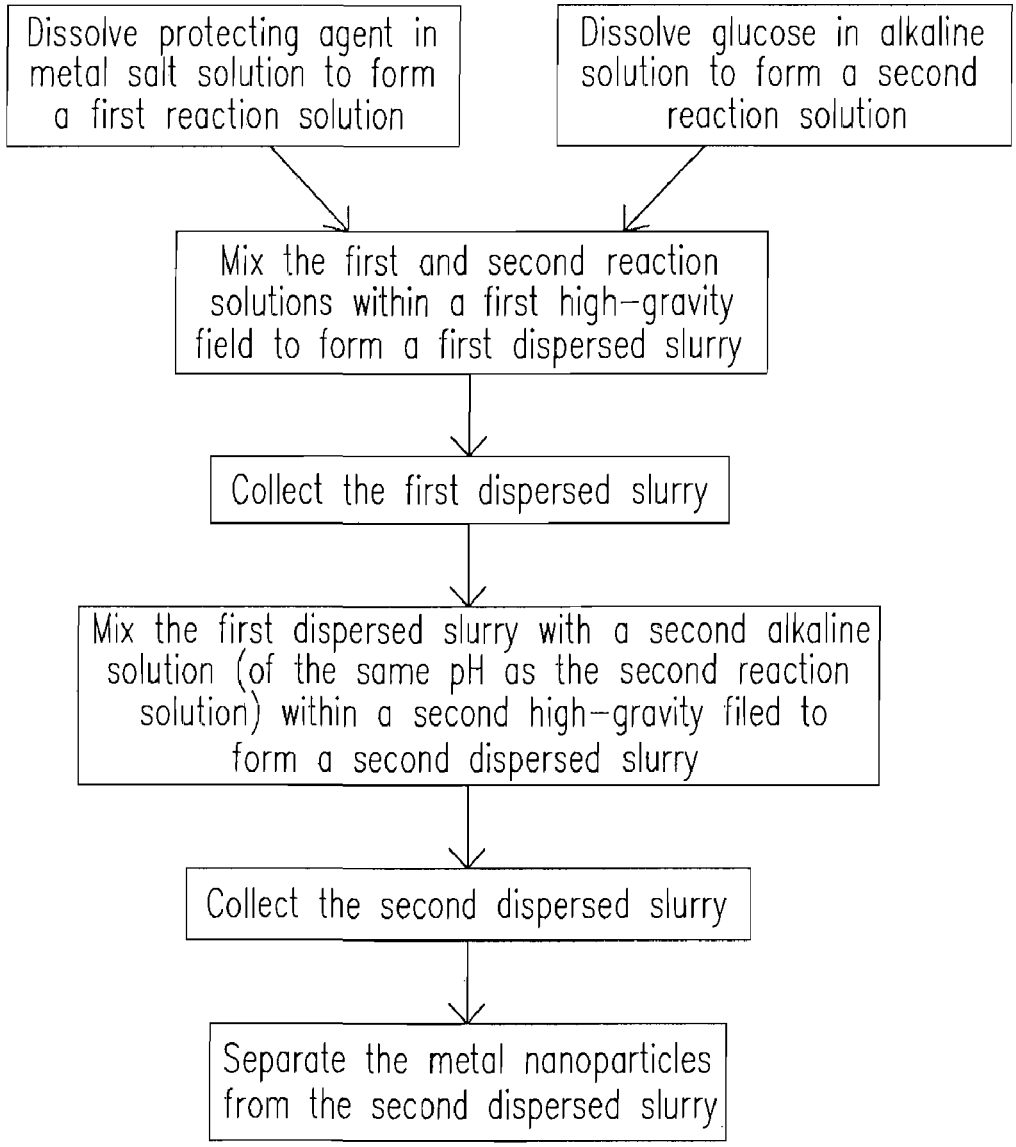
FIG. 5 is a flow diagram illustrating an improved continuous method for manufacturing metal nanoparticles proposed according to an embodiment of the present application.

Please refer to FIG. 3 and FIG. 5. FIG. 5 is a flow diagram illustrating a modified continuous method for manufacturing metal nanoparticles according to a preferred embodiment in the present application. During operation, the flow rates of the solution from first storage tank 17 (1 L of 0.01M silver nitrate solution and dissolved PVP as the same amount of dissolved silver nitrate) and the solution from second storage tank 18 (1 L of 0.01 M glucose solution by adding sodium hydroxide to a pH of 12.9) are both at 0.3 L/min. The two solutions are mixed on the spinning disk 13 (rotating speed of 4000 rpm) and then are collected in the collection tank 16. The mixed slurry collected in collection tank 16 (total of 2 L) at a flow rate of 0.3 L/min is further mixed with sodium hydroxide solution (total volume of 1 L) of pH 12.9 at a flow rate of 0.15 L/min on the spinning disk 13.

The influence of silver salt concentrations, operation methods, and operation-time on the yield and particle size is illustrated in Table 3 below.

TABLE 3

The effect of silver salt concentration, operation method and operation-time on the yield and size of silver nanoparticles.

| Run number | 15 | 16 | 17 | 18 |
|---|---|---|---|---|
| Silver nitrate concentration (M) | 0.01 | 0.10 | 0.01 | 0.15 |
| Sodium hydroxide concentration (M) | 0.07 | 0.07 | 0.07 | 0.07 |
| Glucose concentration (M) | 0.01 | 0.10 | 0.01 | 0.15 |
| Type of protecting agent | PVP | PVP | PVP | PVP |
| Mass ratio of protecting agent to silver nitrate | 0.5 | 0.5 | 1 | 0.6 |
| Operation mode* | cyclic 10 minutes | cyclic 20 minutes | Improved continuous | Continuous |
| yield (%) | 92.0 | 65.8 | 81.0 | 35.5 |
| Number average particle diameter (nm) | 92.0 | 65.8 | 81.0 | 35.5 |
| Volume average particle diameter (nm) | 9.1 | 6.9 | 5.0 | 7.1 |
| | 13 | 9.6 | 6.2 | 8.8 |

*Cyclic refers to the operation mode shown in FIG. 1 and FIG. 2; continuous refers to the operation mode illustrated in the embodiment in FIG. 3; improved continuous refers to the flow chart of operation mode shown in FIG. 5. During operation, the flow rate from collection tank 16 as shown in FIG. 1 is 0.8 L/min whilst the flow rate of solution from storage tank 18 is 0.2 L/min. Disk rotating speed is 4000 rpm. On the other hand, in FIG. 3, the respective flow rate from collection tankand storage tank is 0.3 L/min.

From Table 3, it is shown that different silver salt concentration resulted in different yield. Even when the concentration of silver salt reaches 0.15M, the diameter of silver nanoparticles in the preferred embodiment is still smaller than 10 nm. In run 17 by using the above-mentioned improved continuous operation mode, the yield of silver nanoparticles reached 81% and the number average particle diameter was 5.0 nm. Furthermore, the particle diameter still remains under 10 nm when the silver nanoparticles obtained from this embodiment are re-dispersed in water.

Since the method for manufacturing silver nanoparticles in the embodiment of the present application uses 'green' ingredients, glucose and starch, and is under the conditions created by strong alkaline and employing high-gravity field, the present application does not require formaldehyde that has drastic impact on the environment. In addition, the reaction time required for the present application is very short. Therefore, the present application is novel, non-obvious and applicable to industry when compared to the conventional procedures for manufacturing silver nanoparticles.

The following is a description of a preferred embodiment of the procedure for manufacturing palladium nanoparticles according to a preferred embodiment of the present application.

Since the reducing agent, glucose, has to react under alkaline conditions, sodium hydroxide is added in the embodiment to turn solution alkaline. In addition, since reaction rate is slow at room temperature, the operational environment is kept above 35° C. However, during actual operation of this preferred embodiment, the temperature was kept at 50° C.

Figure 6:
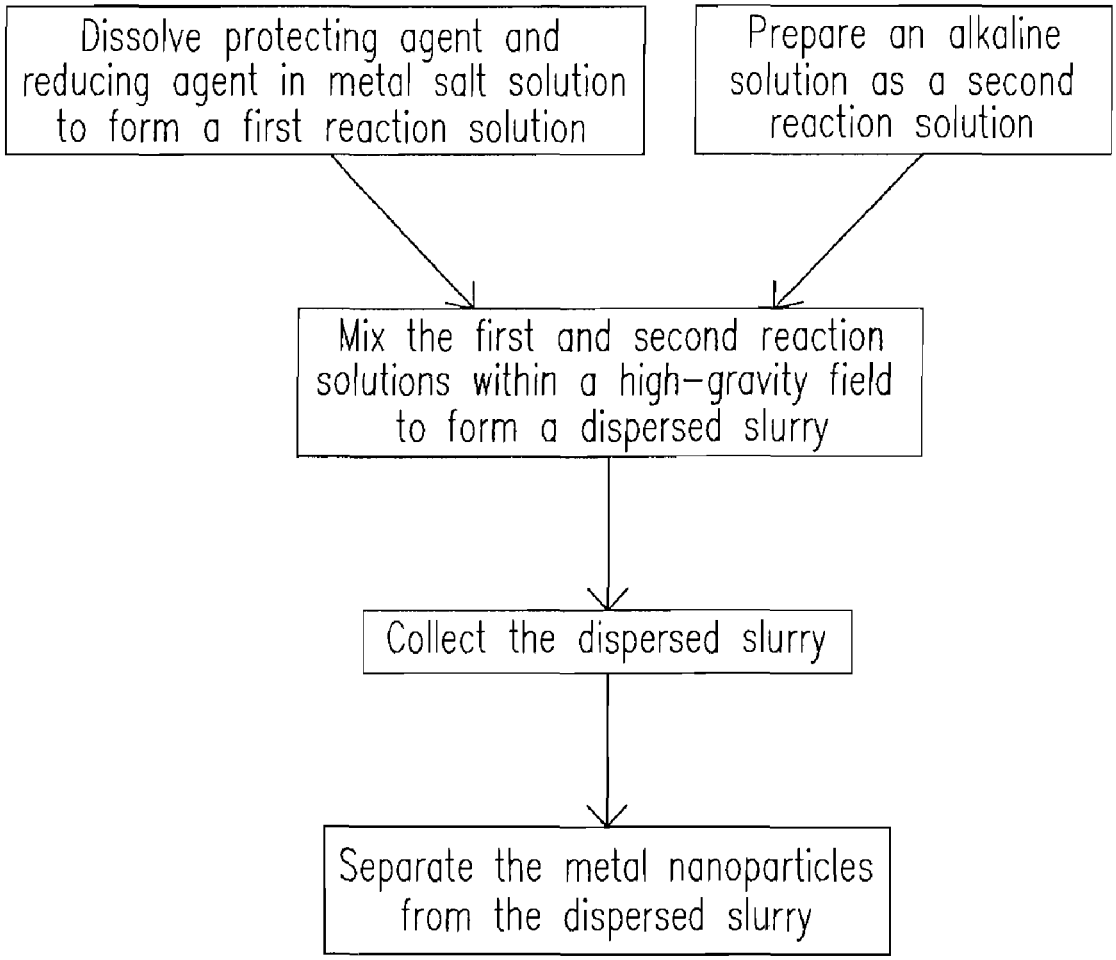
FIG. 6 is another flow chart illustrating a method for manufacturing metal nanoparticles according to another embodiment of the present application.

Please refer to FIG. 1 and FIG. 6. FIG. 6 is another flow diagram illustrating a preferred embodiment of the method for manufacturing metal nanoparticles proposed in the present application, which could also be regarded as another cyclic operation mode. During operation, 500 ml of solution contenting palladium (II) nitrate, protecting agent (PVP) and glucose are initially placed in collection tank 16. Alkaline solution (such as 500 mL of sodium hydroxide solution) is placed in storage tank 18. Alkaline solution and glucose solution are not placed in the same tank to prevent caramelization at high temperature, which would affect the reduction potential of glucose. Hence, they are separated. Both collection tank 16 and storage tank 18 are kept at 50° C.

During operation, the spinning disk 13 is firstly preheated to 50° C., and nitrogen gas of 50° C. is passed through to reactor 14 and collection tank 16 to prevent oxidation of palladium. By controlling first pump 171, and second pump 181, whose flow rates are measured by first flow meter 172 and second flow meter 182, the solutions from both collection tank 16 and storage tank 18 are ejected through first ejecting tube 173 and second ejecting tube 183 onto the surface of spinning disk 13, where these solutions are reacted to form slurry. The reacted slurry is collected in tank 16 to mix with the unreacted solution and the slurry is pumped cyclically to spinning disk 13. After solution in storage tank 18 is completely ejected, the slurry in collection tank 16 continues to recycle for 10 minutes. The flow rate of collection tank 16 is set at 0.8 L/min whilst that of storage tank 18 is at 0.2 L/min. The reaction time in total is 12-15 minutes. The entire procedure is kept at 50° C. under nitrogen atmosphere.

At the end, particles are separated from the slurry and the separated particles are washed with a mixture of water and acetone at a volume ratio of 1:3. The washed product was then dried under vacuum for 2-3 hours. After drying is completed, the yield is calculated by dividing the actual mass gained by the theoretical mass of complete reaction. Zeta-sizer is used to analyze the distribution of particle diameters, whilst the morphology of particles (results not shown) is observed by using Transmission Electron Microscope (TEM) and Scanning Electron Microscope (SEM). The crystal structure of powder samples is determined with a X-ray diffractometer (XRD).

Please refer to Table 4, which shows the effect of operating variables on the diameter of palladium nanoparticles.

TABLE 4

The effect of operating variables on the size of palladium nanoparticles.

| Run number | | 1 | 2 | 3 | 4 |
|---|---|---|---|---|---|
| Solution in collection tank (500 ml) | Palladium (II) nitrate | 0.01M | 0.01M | 0.01M | 0.05M |
| | Glucose | 0.05M | 0.05M | 0.05M | 0.25M |
| Solution concentration in storage tank (sodium hydroxide) (500 mL) | | 1M | 1M | 1M | 2M |
| Mass ratio of PVP to palladium (II) | | 2 | ½ | 1 | 1 |
| Recycle time (min) | | 10 | 10 | 10 | 10 |
| Volume average particle diameter (nm) | | 48.5 | 154.3 | 42.1 | 37.7 |
| Number average particle diameter (nm) | | 26.4 | 24.7 | 24.0 | 23.8 |
| Yield (%) | | 37.3 | 97.2 | 57.2 | 78.3 |

As shown in Table 4, when the operation temperature is around 50° C., pH is above 12.5 and the mass ratio of PVP/palladium (II) nitrate is 1/2, the number average particle diameter of palladium nanoparticles generated is 20-30 nm measured by Zeta-sizer. The sizes of primary particles calculated from XRD patterns by using Deby-Scheirer equation are 3-5 nm. Comparing run 3 and run 4 in Table 4 shows that the higher the concentration of palladium (II) nitrate the greater the yield. In addition, it is to be noted that the salt used is not limited to palladium (II) nitrate and could be of other palladium containing salts, such as palladium (II) chloride and palladium (II) acetate. Since the main purpose of using alkaline solution is to maintain the reaction under a highly alkaline environment, the actual alkaline solution used is not restricted to sodium hydroxide. Therefore, it is not a necessity to use sodium hydroxide only.

Since the method of the present embodiment of the present application for manufacturing palladium nanoparticles uses green ingredients, glucose and PVP, and is under the conditions created by appropriate heating, strong alkaline and employing high-gravity field, the present application does not require formaldehyde that has drastic impact on the environment nor the extremely dangerous hydrazine and NaBH4 (sodium borohydride). In addition, the reaction rate in the present application is five times faster than the conventional technique. Therefore, the present application is novel, non-obvious and applicable to industry when compared to the conventional procedures for manufacturing palladium nanoparticles.

It is to be noted that although the above-mentioned embodiments refer to palladium and silver nanoparticles, the present application that employs high-gravity field created by centrifugation and uses strong alkaline conditions and environmentally friendly 'green' ingredients needs not be limited to manufacturing silver and palladium nanoparticles. The present application would be applicable to manufacturing nanoparticles of other metals, such as gold nanoparticles, platinum nanoparticles, copper nanoparticles and so on.

In summary of the above-mentioned, the method for manufacturing metal nanoparticles proposed in the embodiment of the present application is indeed capable of manufacturing metal particles with diameter in the range of sub-micrometer and nanometer without using reagents that have drastic impact on the environment (such as formaldehyde) or reducing agent that are extremely dangerous to operators (such as hydrazine and sodium borohydride). In addition, the reaction time required for the present application is shorter than the conventional technique. Therefore, the present application has surpassed the conventional technical field at least in both its novelty and non-obviousness. Furthermore, since metal particles with diameter in the range of sub-micrometer and nanometer are highly desirable ingredients in industries, the present application no doubt demonstrates high potential in industrial application.

While the invention has been described in terms of what is presently considered to be the most practical and preferred embodiment, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A method for generating a metal nanoparticle, comprising steps of:

a) mixing a metal salt solution, an additive and a first alkaline solution having a pH greater than 11.5 within a first high-gravity field to form a first dispersed slurry;

b) mixing the first dispersed slurry with a second alkaline solution with a pH greater than 11.5 with a second high-gravity field to form a second dispersed slurry; and c) separating the metal nanoparticle from the slurry.

2. A method as claimed in claim 1 wherein each of the first and second high-gravity fields is ranged from 1 g to 1000 g and provided by centrifugation.

3. A method as claimed in claim 2, wherein each of the first and second high-gravity fields is ranged from 700 g to 1000 g.

4. A method as claimed in claim 1, wherein the additive comprises a reducing agent and a protecting agent.

5. A method for manufacturing a metal nanoparticle, comprising steps of:

a) providing a metal salt solution;

b) providing a reducing agent;

c) providing a protecting agent;

d) providing an alkaline solution;

e) mixing the salt solution, the reducing agent, the protecting agent and the alkaline solution to form a slurry within a high-gravity field ranged from 700 g to 1000 g and provided by a centrifugation; and f) separating the metal nanoparticle from the slurry.

6. A method for forming a metal nanoparticle, comprising steps of:

a) mixing a metal salt solution, an additive and an alkaline solution having a pH greater than 11.5 within a high-gravity field ranged from 700 g to 1000 g and provided by a centrifugation to form a slurry; and b) separating the metal nanoparticle from the slurry.

* * * * *